United States Patent [19]

Watkins et al.

[11] Patent Number: 4,778,952

[45] Date of Patent: Oct. 18, 1988

[54] KEY SWITCH ASSEMBLY

[75] Inventors: Richard R. Watkins; Dale E. Brumit; Thomas R. Coey, all of Tucson, Ariz.

[73] Assignee: Eaton Corporation, Cleveland, Ohio

[21] Appl. No.: 41,467

[22] Filed: Apr. 23, 1987

[51] Int. Cl.[4] ..... H01H 3/12

[52] U.S. Cl. ..... 200/5 A; 200/159 B; 200/317; 200/292

[58] Field of Search ..... 200/5 A, 159 B, 317, 200/314, 315, 292

[56] References Cited

U.S. PATENT DOCUMENTS 4,360,722 11/1982 Georgopulos ..... 200/314

4,659,881 4/1987 Dowe ..... 200/159 B X 4,705,925 11/1987 Vermeulen ..... 200/159 B

*Primary Examiner*—A. D. Pellinen

*Assistant Examiner*—Morris Ginsburg

*Attorney, Agent, or Firm*—L. G. Vande Zande

[57] ABSTRACT

A key switch assembly for direct mounting on a PCB or similar substrate. The key switch has a body with depending mounting pin having retainers thereon to secure the key switch at apertures in the substrate. The key switch body includes a snappable dome moveable from a non-actuated position to an actuated position in direct contact with conductive elements in the substrate by manual depression of a key.

8 Claims, 2 Drawing Sheets

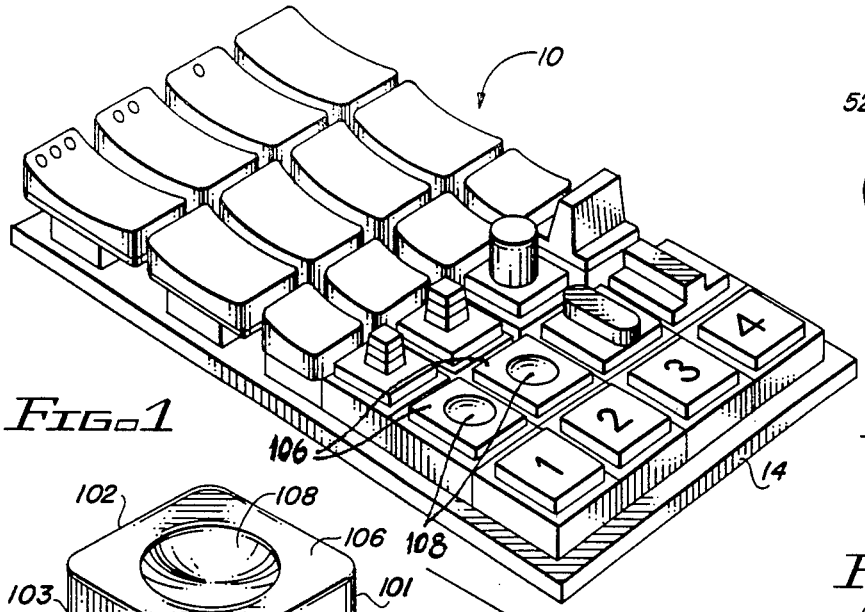
FIG. 1
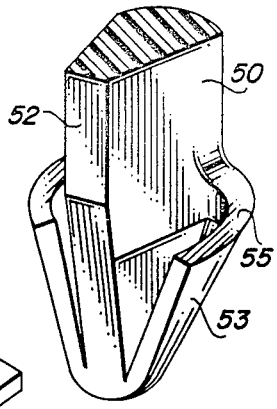
FIG. 3
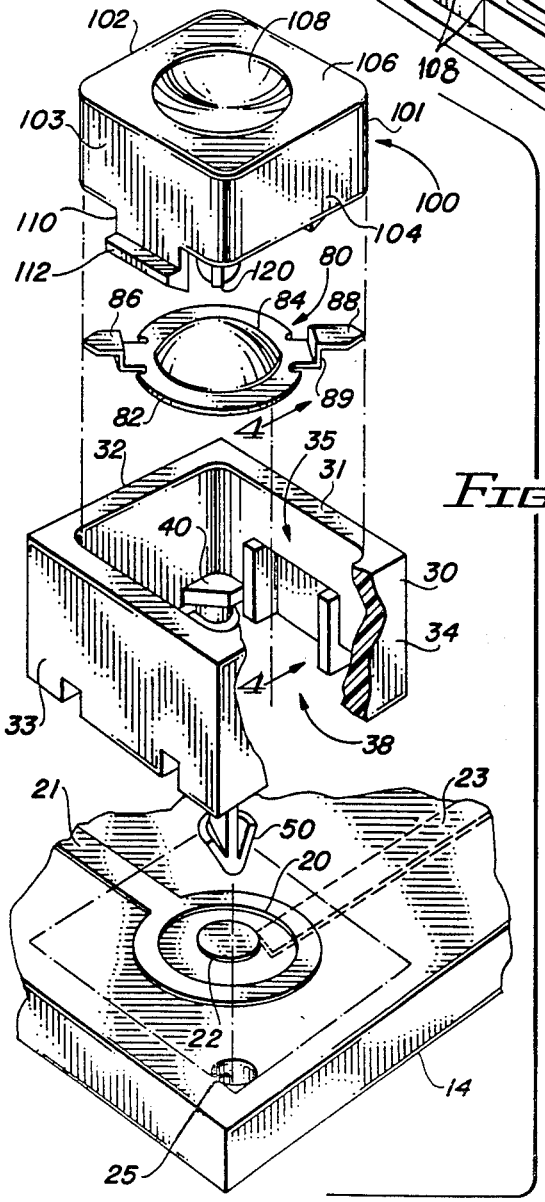
FIG. 2
FIG. 4
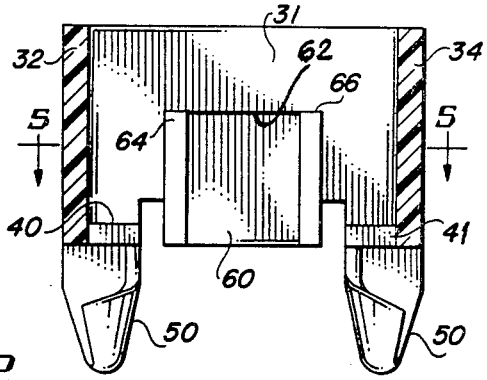
FIG. 5
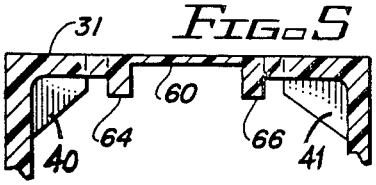
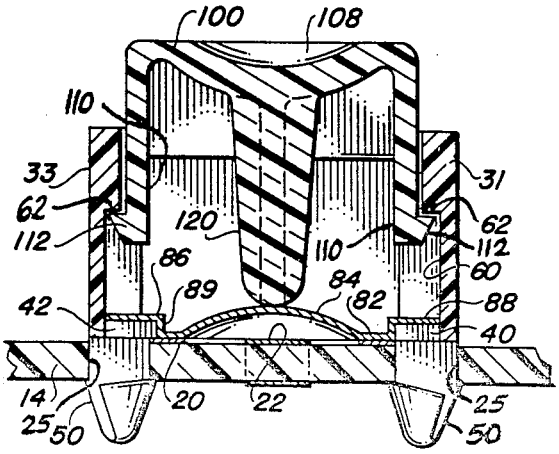
FIG. 6

KEY SWITCH ASSEMBLY

The present invention relates to switches and more particularly to a keyboard switch assembly with tactile feedback for use in keyboards or electronic devices.

The construction of electronic calculators, keyboards and other electronic apparatus for digital control and data entry utilize snap-action, resilient contact elements in conjunction with conductive substrates such as printed circuit boards (PCB's). The substrate carries a plurality of conductive circuit paths which are selectively bridged upon depression or actuation of the conductive resilient contact elements. The contact elements may be of different configurations but these elements are generally dome shaped and are disposed on the substrate with an edge portion of the dome being in electrical and physical contact with a portion of one conductive path. The central region of the resilient dome aligns with another conductive path portion on the substrate so as to enable electrical connection between the paths when the dome is actuated by application of manual pressure forcing the dome downwardly into contact with the subjacent conductive path portion. The dome shape is preferred because it exhibits the tactile snap action although various other contact elements and other geometric shapes are also found in the prior art. In some applications, the contact elements may be directly actuated by the user in which case the user simply applies force with a finger or instrument to cause actuation. However, in the construction of many components such as keyboards, the use of a key switch to actuate the contact element is preferred. In addition to providing the tactile snap action of positive switching, a key switch can be provided in different sizes and shapes depending upon the design requirements and user preference.

Products such as computer data terminals and telephones utilize keyboard switch assembles in which the snapaction contact member is actuated by a key switch. Generally these assemblies are constructed with a keyboard overlying the conductive substrate. The key switches are located at predetermined locations on the board and are hingedly secured so that they are bendable or depressable to engage and operate the associated contact members. Typical U.S. Patents in the prior art showing switches of this type are U.S. Pat. Nos. 4,355,483; 4,323,740; 4,032,729; 4,128,744; 4,190,748; 4,360,722; and 4,582,967.

While key switch assemblies as generally discussed above are widely accepted in the industry and are well suited for their intended purpose, certain deficiencies and limitations are inherent in such devices. One problem arises due to the fact that such key switch assemblies are normally secured either directly to the PCB or to a smaller printed circuit member by soldering. The soldering process inherently involves the introduction of contamination to the electrical components due to the solder and to the flux used in this operation. In addition to the contamination problem, the securement of switches by conventional soldering techniques such as by wave soldering requires additional manufacturing operations. Once the switches are secured by solder, they are more difficult to remove from the board as the solder connection must be melted prior to replacement or repair.

Accordingly, it is an object of the present invention to provide an improved key switch assembly which is versatile, simple and easy to install and provide the key-board designer great flexibility designing custom boards.

The above objects of the present invention are accomplished by a key switch assembly which attaches directly on a PCB or other similar substrate. The key switch has a body provided with one or more depending mounting pins having retainers thereon to secure the key switch at predetermined locations at apertues in the substrate. The key switch body includes a snappable dome moveable from a nonactuated position to an actuated position in direct contact with conductive elements on the substrate to establish electrical connection. Soldering and contamination attendant to the soldering process is eliminated. Further, the key switch of the present invention is easily mountable and removable from the substrate.

Accordingly, it is an important object of the present invention to provide an improved key switch assembly providing snap action with tactile feedback which is attachable to a substrate without the necessity of soldering operations.

A further object of the present invention is to provide an improved keyboard assembly and key switch mechanism which is economical to produce and is reliable in operation.

Still another object of the present invention is to provide a key switch assembly which provides positive actuation of the conductive element or dome.

Still another object of the present invention is to provide a keyboard assembly and keyboard switch mechanism which is detachably securable to the substrate at mounting pins and which switch provides substantial flexibility to the designer.

Other objects and advantages of the present invention will be apparent to and understood by those skilled in the art from the following detailed description and drawings in which:

FIG. 1 is a perspective view of a portion of a keyboard assembly incorporating the key switch actuator of the present invention;

FIG. 2 is an exploded view illustrating a portion of the substrate and the keyswitch assembly of the present invention;

FIG. 3 is an enlarged detail view of the key switch mounting pin;

FIG. 4 is a sectional view taken along lines 4—4 of FIG. 2;

FIG. 5 is a partial sectional view taken along lines 5—5 of FIG. 4;

FIG. 6 is a sectional view of the assembled keyboard switch.

Figure 7:
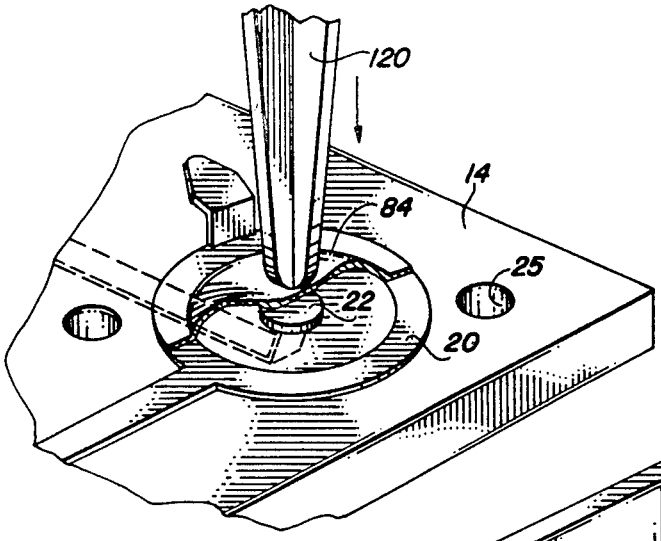
FIG. 7 is a detail view of the actuator pin and snappable dome with certain elements eliminated for clarity.

Turning now to the drawings, particularly FIGS. 1 to 6, which show a keyboard generally designated by the numeral 10. Keyboard 10 is of the type commonly utilized in connection with computer terminals and other similar electronic equipment. Keyboard 10 consists of a housing, not shown, within which is a substrate 14 such as a PCB containing appropriate conductive artwork. Typical artwork is shown in FIG. 2 and includes a generally circular or arcuate section 20 connected to electrical pathway 21. Contact element 22 is centrally disposed within arcuate portion 20 and electrical pathway 23 extends from contact element 22 along the back side of substrate 14. Snappable dome contacts are generally mounted directly on the substrate 14 with the periphery of the dome resting on or in contact with arcuate or circular contact portion 20. When the dome is depressed, the central region of the dome is placed in contact with contact element 22.

With the present invention, substrate 14 is fabricated having one or more mounting holes or apertures 25 disposed adjacent the conductive artwork. Apertures 25 extend through the substrate and are adapted to directly mount key switch housing 30 on the upper surface of the substrate. The key switch housing 30 is formed of a suitable non-conductive material such as ABS or the like.

Housing 30 is shown having side walls 31, 32, 33 and 34 forming a rectangular enclosure having an open upper end 35 and an open lower end 38. A rest or platform 40 extends diagonally at the lower end of walls 31 and 32. Similarly, a rest or platform 42 extends at the lower end of walls 33 and 34 diagonally opposite rest 40. Another pair of rests or platforms, such as seen at 41 in FIGS. 4 and 5, are provided in the opposite diagonal pairs of corners of housing 30. A retainer pin 50 depends from the underside of platforms 40 and 42. Pins 50 are adapted to align with apertures 25. Each of the pins 50 includes an elongate body 52 terminating at a head 53. Head 53 is generally conical having outwardly extending wings or flukes 55 which are flexible. The flukes or wings 55 will collapse when they are forced through the aperture 25 and upon emerging at the underside of the substrate 14 will expand to the position shown in FIG. 3 securing the body 30 in place on the substrate.

Opposite side walls 33 and 31 are each provided with a recess 60. Recess 60 extends vertically in a central location intercepting the bottom edge of the side wall and terminating at an intermediate location at horizontal shoulder 62. Vertically extending guide members 64 and 66 are provided adjacent the sides of recess 60. As will be explained hereafter, the leg of the key switch cap 100 is engageable in the recess 60 in an assembled position.

Contact member 80 is generally hemispherical having a peripheral edge portion 82 and an elevated dome portion 84. The contact member 80 is formed of metal or other conductive material and the peripheral edge 82 of the member generally corresponds to conductive path 20. Mounting tabs 86 and 88 extend oppositely from the peripheral edge 82 and are vertically offset at shoulder 89. The mounting tabs 86 and 88 are adapted to rest on platforms 40 and 42 or on the opposite pair of platforms, one of which is shown at 41. As best seen in FIG. 6, the offset at shoulder 89 permits the contact in the assembled position to assume a position with peripheral edge 82 of the contact member 80 resting on conductive path 20. In the assembled position dome 84 is elevated above contact element 22 on the substrate 14.

The contact 80 is actuated or depressed by means of key cap 100. The key cap is an integral or one-piece assembly preferably molded from a suitable non-conductive plastic material such as ABS and may be made by injection molding or other well-known fabrication techniques. The key cap is rectangular with side walls 101, 102, 103 and 104 which closely conform to the interior of body 30 permitting the key switch movement. The upper surface 106 of the cap may have a recess or depression 108 to receive the tip of the finger of the user to facilitate manual actuation of the key switch member. A striker pin 120 extends vertically from the underside of the surface 106 and is aligned and dimensioned to contact the center portion of dome 84 in the assembled, non-actuated position as best shown in FIG. 6.

The key cap is mounted to body 30 by means of legs 110 which depend from sides 101 and 103. The lower edge of each leg 110 is provided with a transversely extending flange 112 which is engageable at shoulder 62 as best seen in FIG. 6 each leg 110 is received within the guide members 64 and 66. Switch closure is accomplished by exerting a manual downward force on the upper surface 106 of the cap at 108 which depresses the key cap 100 downwardly within housing 30. The downward movement of the key cap will depress the dome portion 84 by means of the elongated striker or pin 120 which, in turn, brings a portion of the dome 84 into contact with element 22 on the substrate establishing electrical connection. Although the key cap 100 is shown as being guided for linear depression within housing 30, it will be recognized by those skilled in this art that appropriate relaxation of tolerances between the opening 35 of housing 30 and key cap 100 and between legs 110 and guides 64 and 66 will permit the cap 100 to pivot downwardly about one or the other flanges 112 to effect depression of dome 84, particularly where the surface 106 is large and manual pressure is applied off-center.

In use, the operator applies manual force to the key switch by means of downward pressure with the tip of the finger at depression 108 on the key cap 100. When pressure is applied, the key cap moves downwardly force to the dome switch by means of the actuator or striker pin 120. Thus, positive and tactile actuation is achieved through the use of the key switch.

As pointed out above, the key switch may be easily assembled on the PCB without the necessity of soldering operations. The switch is quickly and conveniently secured to the board by simply inserting the retainer pins 50 in the appropriate apertures 25 provided in the substrate. The expandable retaining wings 55 associated with head 53 of the retainer pins will expand to securely position the key switch in place. If it is desired to remove the key switch, the outwardly expandable retaining wings 55 may be manually collapsed to allow them to be withdrawn upwardly through the apertures in the substrate. The key switch body 30 is preferably configured as shown in FIG. 2 with a mounting recess 60 provided in opposite side walls so that in embodiments permitting hinging motion of the key cap, the winging may occur at either wall. It is, of course, within the scope of the invention to provide hinged mountings at any of the interior side walls so that the assembler could orient the hinge connection at the interior of any of the four side walls.

Unitary assembly of the present invention reduces the cost of manufacturing and increases reliability. Because each key switch assembly is independent, custom design of keyboards is facilitated giving the electronics designer great flexibility. Further, maintenance is easy in that if a problem exists with a single key switch, one only need remove and replace the particular key switch which is determined as being a problem. Key caps can be individualized and identified by appropriate indicia or color and provided in different sizes and shapes, as shown in FIG. 1.

Figure 8:
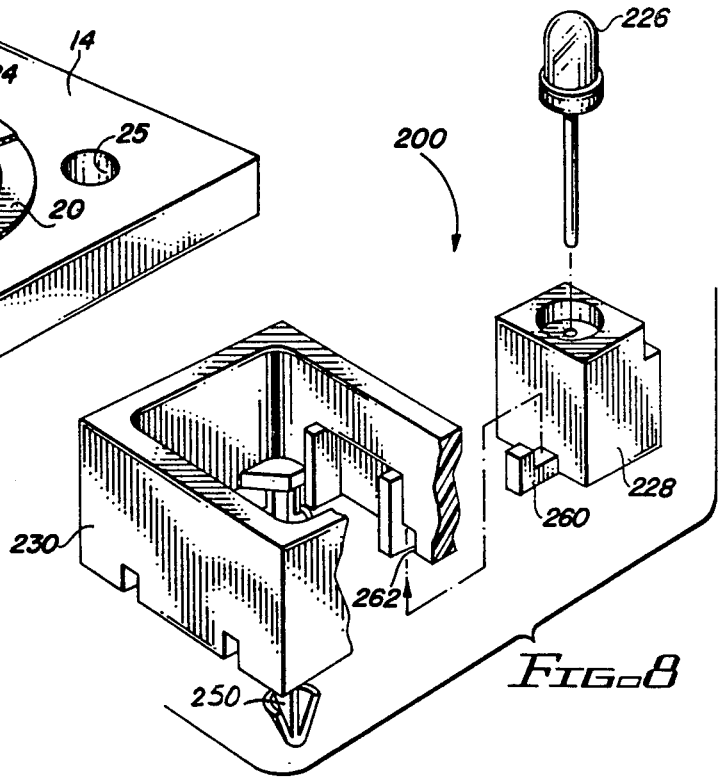
FIG. 8 is an exploded view of an alternate embodiment of the present invention.
Figure 9:
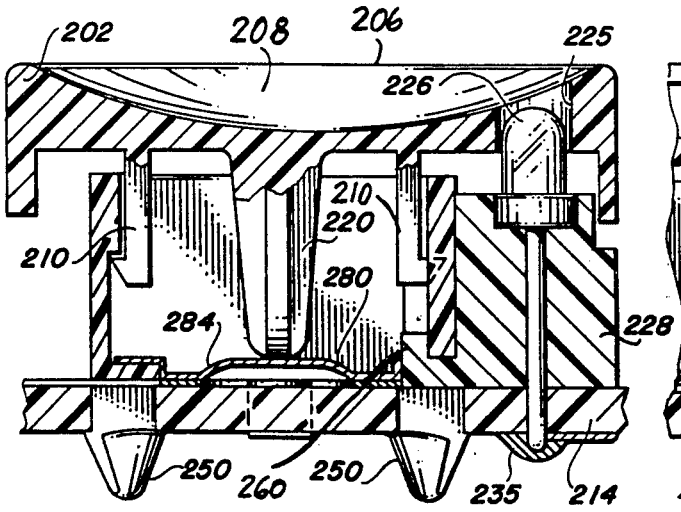
FIGS. 9 and 10 are sectional views of the alternate embodiment of keyboard switch assembly of FIG. 8 showing, respectively, the non-actuated and actuated positions.
Figure 10:
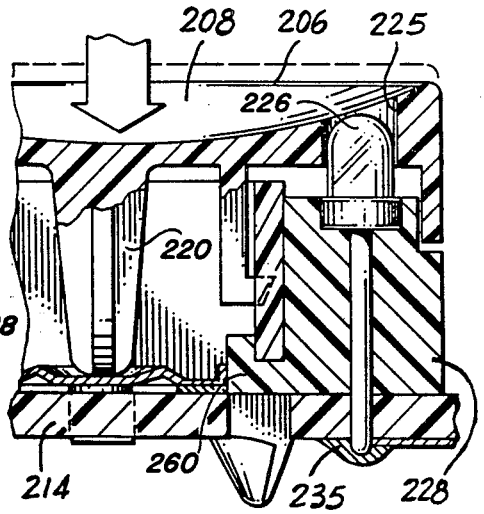

FIGS. 8 to 10 show an alternate embodiment of the present invention which is generally designated by the numeral 200. Key switch assembly 200 includes a body member 230 secured to a substrate 214 by depending retainer pins 250. A key cap 202 is mounted within the body member 230 by legs 210. Depending actuator pin 220 serves to depress the dome 284 of hemispherical contact member 280. In regard to the features described above, they are generally identical or similar to those set forth with reference to FIGS. 1 to 6 and, therefore, further detailed description is not believed necessary.

In embodiment 200, key cap 202 is enlarged extending laterally beyond the sides of body 230. The upper surface 206 of the key cap is shown as having large spherical depression 208, but may also be formed to generally arcuate configuration as seen for the switches in the left-hand half of the keyboard illustrated in FIG. 1. A peripheral edge of the key cap defines an aperture 225 which receives LED 226. LED 226 is secured to LED holder 228 mounted adjacent the key switch body. LED 226 is connected to contact point 235 on substrate 214. The LED holder may be formed as an integral part of body 230 or may be a separable component secured thereto at notch 262 by locking tab 260.

In assembly, the key switch of this embodiment, the LED holder 228 containing LED 226 is first secured to the board 214 at contact 235. Thereafter, the key switch body is secured in place in the appropriate apertures in the board and the key switch engaged to the body in a pivotal position.

The present invention has been described with reference to several specific embodiments thereof for the purpose of illustrating the manner in which the invention may be used. It will be appreciated by those skilled in the art that the invention is not limited to these specific embodiments. Accordingly, any and all modifications, variations or equivalent arrangements which may occur to those skilled in the art should be considered within the spirit and scope of the invention and the appended claims.

We claim:

1. A key switch assembly comprising:

a substrate having apertures therein at predetermined locations and means defining first and second electrically conductive paths thereon;

a body member having an opening therethrough extending from an upper end to a lower end thereof, positioning means at said lower end comprising platforms extending into said opening, and mounting means depending from said body member adapted to secure said body to said substrate at said apertures;

a snap dome electric contact having a planar peripheral rim and support tabs extending radially from said rim, said tabs being offset upwardly in the direction of said dome, said contact being disposed in said opening with said tabs resting on said platforms of said positioning means, thereby retaining said contact in said body prior to attachment to said substrate, said tabs and said positioning means cooperatively laterally positioning said contact in registration with said first electrically conductive path upon attachment to said substrate, and key means operatively attached to said body member having an extended non-actuated position and a depressed actuated position, said key means including striker means engaging said dome in said extended position biasing said contact rim against said first electrically conductive path establishing electrical continuity therebetween, and depressing said dome into contact with said second electrically conductive path in said depressed actuated position, snap action of said dome being directly transmitted to said key means through said striker means as tactile feedback to an operator.

2. The key switch assembly of claim 1 wherein said contact rests on said platforms from the upper end of said body member.

3. The key switch assembly of claim 2 wherein said positioning means are located at diagonally opposite corners of said body member and comprise said platforms extending diagonally between adjacent sides of said body member at said opposite corners and further comprises interior surfaces of said adjacent sides of said body member.

4. The key switch assembly of claim 3 wherein free ends of said support tabs are formed to symetrically engage said interior surfaces of said adjacent sides to align said contact diagonally within said body member.

5. The key switch assembly of claim 1 wherein said mounting means comprises flexible depending members insertable into said apertures to secure said body member to said substrate by a snap-in fit.

6. A key switch assembly comprising:

a body member having depending mounting means adapted to engage apertures in a substrate, said mounting means attaching said body member to said substrate at a predetermined location, and positioning means in said body member;

a snap dome electric contact carried by said body member, said contact having support means cooperable with said positioning means retaining said contact to said body member prior to attachment thereof to said substrate and positioning a peripheral planar rim of said contact in registration with a first electrically conductive path on said substrate and a dome portion of said contact in spaced overlying registration with a second electrically conductive path on said substrate when said body member is attached to said substrate; and key means operatively attached to said body member having an extended non-actuated position and a depressed actuated position, said key means including striker means engaging said dome portion in said extended position biasing said rim against said first conductive path when said body member is attached to said substrate establishing electrical continuity therebetween, and depressing said dome portion into engagement with said second conductive path in said depressed position, said dome portion moving with a snap action directly transmitted to said key means through said striker means as tactile feedback to an operator.

7. The key switch assembly of claim 6 wherein:

said body member has an opening therethrough from an upper end to a lower end;

said positioning means comprise platforms extending into said opening proximate said lower end; and said support means comprise tabs extending outwardly from said planar rim offset upwardly, said tabs resting on upper surfaces of said platforms.

8. The key switch assembly of claim 7 wherein said positioning means are located at diagonally opposite corners of said body member and further include internal surfaces of adjacent sides of said body member, and free ends of said support means tabs are formed to cooperate with said internal surfaces to align said tabs diagonally and said dome centrally within said said body member.

* * * * *